US007751745B2

(12) United States Patent
Noh et al.

(10) Patent No.: US 7,751,745 B2
(45) Date of Patent: Jul. 6, 2010

(54) DEVELOPING APPARATUS, IMAGE FORMING APPARATUS HAVING THE SAME, AND ASSEMBLING METHOD OF A DEVELOPING APPARATUS

(75) Inventors: Joo-hwan Noh, Yongin-si (KR); Yong-ju Cheon, Suwon-si (KR)

(73) Assignee: Samsung Electronics Co. Ltd, Suwon-si (KR)

( * ) Notice: Subject to any disclaimer, the term of this patent is extended or adjusted under 35 U.S.C. 154(b) by 164 days.

(21) Appl. No.: 12/015,664

(22) Filed: Jan. 17, 2008

(65) Prior Publication Data

US 2009/0022512 A1 Jan. 22, 2009

(30) Foreign Application Priority Data

Jul. 18, 2007 (KR) ..... 10-2007-0071837

(51) Int. Cl.
*G03G 15/08* (2006.01)

(52) U.S. Cl. ..... 399/103; 399/88; 399/256

(58) Field of Classification Search ..... 399/103, 399/105, 88, 254, 256, 107, 110, 167
See application file for complete search history.

(56) References Cited

U.S. PATENT DOCUMENTS 5,134,441 A 7/1992 Nagata et al.
6,188,856 B1 2/2001 Sato
6,480,686 B2 * 11/2002 Hilbert et al. ..... 399/103
6,968,144 B2 * 11/2005 Mizoguchi ..... 399/167
2003/0059233 A1 * 3/2003 Jang et al. ..... 399/167
2007/0025756 A1 * 2/2007 Carter et al. ..... 399/103

FOREIGN PATENT DOCUMENTS

EP 0822467 A2 2/1998
JP 2004053950 2/2004
KR 1996-38339 12/1996

OTHER PUBLICATIONS

European Search Report issued Nov. 17, 2008 in Europe Application No. 08153199.8.
Korean Office Action issued Mar. 6, 2009 in KR Application No. 2007-0071837.

* cited by examiner

*Primary Examiner*—Sophia S Chen
(74) *Attorney, Agent, or Firm*—Stanzione & Kim LLP

(57) ABSTRACT

A developing apparatus usable with an image forming apparatus includes a developer receptacle having a sidewall on which a shaft hole is formed, a rotation shaft having a length shorter than a distance between opposite sidewalls of the developer receptacle and an end on which a connection hole is formed, and a driving member rotatably supported by the shaft hole of the developer receptacle and having a connecting shaft inserted into the connection hole of the rotation shaft.

25 Claims, 6 Drawing Sheets

FIG. 1
(CONVENTIONAL)
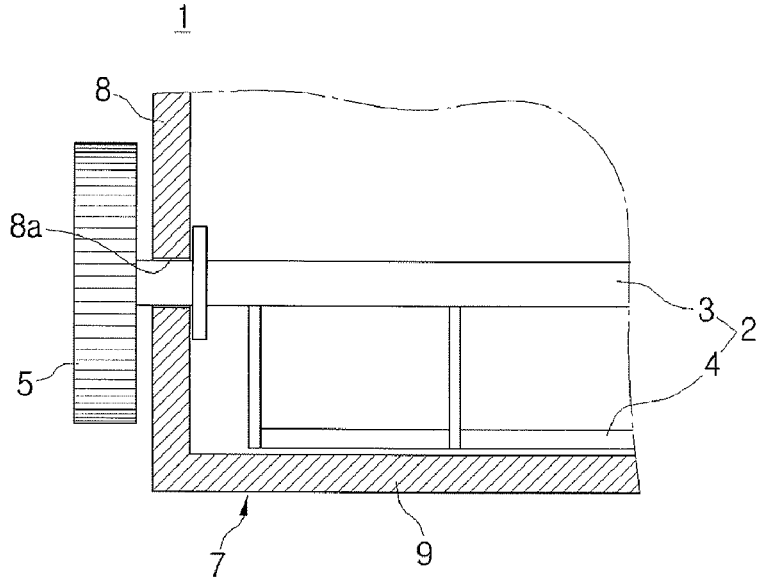

DEVELOPING APPARATUS, IMAGE FORMING APPARATUS HAVING THE SAME, AND ASSEMBLING METHOD OF A DEVELOPING APPARATUS

CROSS-REFERENCE TO RELATED APPLICATIONS

This application claims priority under 35 U.S.C. §119(a) from Korean Patent Application No. 2007-71837 filed Jul. 18, 2007 in the Korean Intellectual Property Office, the disclosure of which is incorporated herein by reference in its entirety.

BACKGROUND OF THE INVENTION

1. Field of the Invention

The present general inventive concept relates to an image forming apparatus. More particularly, the present general inventive concept relates to a developing apparatus, an image forming apparatus having the same, and an assembling method of the developing apparatus.

2. Description of the Related Art

Generally, an electro photographic image forming apparatus includes a developing apparatus having a photosensitive medium to form an electrostatic latent image corresponding to printing data, and a developing roller to supply developer to the photosensitive medium to develop the electrostatic latent image into a visible image.

The developing apparatus also includes a developer-storing portion in which a predetermined amount of developer is stored. An agitator is disposed inside the developer-storing portion and agitates the developer to prevent the stored developer from solidifying. The agitator is rotatably disposed inside the developer-storing portion of the developing apparatus.

Generally, the agitator rotates by power transmitted from a power-transmitting unit to allow the photosensitive medium and the developing roller of the developing apparatus to rotate.

FIG. 1 is a partial sectional view illustrating a driving member 5 and a rotation shaft 3 of an agitator 2 of a developing apparatus 1 for a conventional image forming apparatus.

A gear is used as the driving member 5, so the gear 5 receives power from a power transmitting unit (not illustrated). The gear 5 is disposed on the rotation shaft 3 of the agitator 2. Opposite ends of the rotation shaft 3 are rotatably supported by a developer receptacle 7. As a result, rotating the gear 5 allows the rotation shaft 3 to rotate. When the rotation shaft 3 rotates, an agitating member 4 fixed to the rotation shaft 3 mixes the developer.

At this time, a sidewall 8 of the developer receptacle 7 is provided with a shaft hole 8*a* through which the rotation shaft 3 of the agitator 2 is inserted. Accordingly, when assembling the agitator 2 to the developer receptacle 7, the rotation shaft 3 is inclined with respect to a bottom surface 9 of the developer receptacle 7, and then, an end of the rotation shaft 3 is inserted into the shaft hole 8*a* formed at the sidewall 8 of the developer receptacle 7.

However, if the rotation shaft 3 needs to be inclined for assembly using automatic machines such as robots, etc. in order to automatically assemble the developing apparatus 1 is difficult as most of the automatic machines like robots used in factories are designed and manufactured to linearly move only in a vertical and/or horizontal direction.

Also, in the developing apparatus 1 having a connection structure between the driving member 5 and the rotation shaft 3 of the agitator 2 as described above, the developer can leak from the developer receptacle 7 through a gap between the shaft hole 8*a* and the rotation shaft 3.

SUMMARY OF THE INVENTION

The present general inventive concept provides a developing apparatus having a driving member and a rotation shaft of an agitator that can be assembled by automatic machines, an image forming apparatus having the same, and an assembling method of the developing apparatus.

The present general inventive concept also provides a developing apparatus to prevent developer stored in the developing apparatus from being leaked through a gap between a rotation shaft and a shaft hole, an image forming apparatus having the same, and an assembling method of the developing apparatus.

Additional aspects and utilities of the present general inventive concept will be set forth in part in the description which follows and, in part, will be obvious from the description, or may be learned by practice of the general inventive concept.

The foregoing and/or other aspect and utilities of the present general inventive concept can substantially be achieved by providing a developing apparatus usable with an image forming apparatus, the developing apparatus including a developer receptacle having a sidewall on which a shaft hole is formed, a rotation shaft having a length shorter than a distance between opposite sidewalls of the developer receptacle and an end on which a connection hole is formed, and a driving member rotatably supported by the shaft hole of the developer receptacle and having a connecting shaft inserted into the connection hole of the rotation shaft.

The developing apparatus may include a sealing member seat formed around the shaft hole on the sidewall of the developer receptacle, and a sealing member disposed in the sealing member seat to seal an outer circumferential surface of the connecting shaft of the driving member.

The sealing member may be formed substantially in a U shape or in a bell shape.

The connection hole of the rotation shaft may include a plurality of coupling protrusions formed in an axial direction thereof.

The driving member may include a plurality of coupling grooves formed on an outer circumferential surface of the connecting shaft corresponding to the plurality of coupling protrusions.

The driving member may include a plurality of partitions to form the plurality of coupling grooves. One partition of the plurality of partitions may be longer than other partitions.

The developing apparatus may include an agitator disposed on the rotation shaft to agitate developer stored in the developer receptacle.

The foregoing and/or other aspects and utilities of the present general inventive concept can also be achieved by providing a developing apparatus usable with an image forming apparatus, the developing apparatus including a developer receptacle, a rotation shaft having a length shorter than a distance between opposite sidewalls of the developer receptacle, and an end on which a connection hole is formed, a shaft supporting member disposed at the one sidewall of the developer receptacle, and having a shaft supporting hole, and a driving member rotatably supported by the shaft supporting hole of the shaft supporting member, and having a connecting shaft inserted into the connection hole of the rotation shaft.

The shaft supporting member may include a sealing member fixing hole formed at the same axis as the shaft supporting hole. A sealing member may be disposed in the sealing member fixing hole to seal an outer circumferential surface of the connecting shaft of the driving member.

The foregoing and/or other aspects and utilities of the present general inventive concept can also be achieved by providing an image forming apparatus, which includes a printing medium feeding unit, a developing apparatus to form an image on a photosensitive medium, a transfer roller to allow the image formed on the photosensitive medium to be transferred onto a printing medium fed from the printing medium feeding unit, and a fixing unit to fix the image onto the printing medium, wherein the developing apparatus may include a developer receptacle having a sidewall on which a shaft hole is formed, a rotation shaft having a length shorter than a distance between opposite sidewalls of the developer receptacle, and an end on which a connection hole is formed, and a driving member rotatably supported by the shaft hole of the developer receptacle, and having a connecting shaft inserted into the connection hole of the rotation shaft.

The foregoing and/or other aspects and utilities of the present general inventive concept can also be achieved by providing an image forming apparatus, which includes a printing medium feeding unit, a developing apparatus to form an image on a photosensitive medium, a transfer roller to allow the image formed on the photosensitive medium to be transferred onto a printing medium fed from the printing medium feeding unit, and a fixing unit to fix the image onto the printing medium, wherein the developing apparatus may include a developer receptacle, a rotation shaft having a length shorter than a distance between opposite sidewalls of the developer receptacle, and an end on which a connection hole is formed, a shaft supporting member disposed at the one sidewall of the developer receptacle, and having a shaft supporting hole, and a driving member rotatably supported by the shaft supporting hole of the shaft supporting member, and having a connecting shaft inserted into the connection hole of the rotation shaft.

The foregoing and/or other aspects and utilities of the present general inventive concept can also be achieved by providing an assembling method of a developing apparatus, the method including assembling a sealing member in a sealing member seat of a developer receptacle, inserting a rotation shaft having a length shorter than a distance between opposite sidewalls of the developer receptacle into the developer receptacle while remaining horizontal with respect to a bottom surface of the developer receptacle, positioning the rotation shaft in a same axis as the sealing member seat, and inserting a connecting shaft of a driving member into a connection hole of the rotation shaft through the sealing member from outside one sidewall of the developer receptacle.

The rotation shaft may be supported by a rotation shaft supporting member disposed on a bottom surface of the developer receptacle.

The foregoing and/or other aspects and utilities of the present general inventive concept can also be achieved by providing a rotation shaft, which is rotatably disposed in a developer receptacle of a developing apparatus usable with an image forming apparatus. The rotation shaft may include a length being shorter than a distance between opposite sidewalls of the developer receptacle, a connection hole formed on an end of the rotation shaft, and into which a connecting shaft of the driving member is inserted, and an agitating member disposed on the rotation shaft.

The rotation shaft may include a plurality of coupling protrusions formed on an inner circumferential surface of the connection hole in an axial direction thereof. The connecting shaft of the driving member may include a plurality of coupling grooves formed on an outer circumferential surface of the connecting shaft corresponding to the plurality of coupling protrusions.

The foregoing and/or other aspects and utilities of the present general inventive concept can also be achieved by providing a sealing member of a developing apparatus, which is disposed in a developer receptacle of the developing apparatus usable with an image forming apparatus. The sealing member may be formed substantially in a U shape, and may include a first end of the sealing member having a diameter corresponding to a diameter of a sealing member seat formed on a sidewall of the developer receptacle, and inserted into the sealing member seat, and a sealing hole formed on a second end of the sealing member to contact an outer circumferential surface of a connecting shaft of a driving member.

The foregoing and/or other aspects and utilities of the general inventive concept may also be achieved by providing a developing apparatus usable with an image forming apparatus, the developing apparatus including a developer receptacle having a bottom surface, a rotation shaft to linearly move in a vertical direction to the bottom surface while remaining horizontal with respect to the bottom surface and a driving member to connect to the rotation shaft.

BRIEF DESCRIPTION OF THE DRAWINGS

These and/or other aspects and utilities of the present general inventive concept will become apparent and more readily appreciated from the following description of the embodiments, taken in conjunction with the accompanying drawings of which:

FIG. 1 is a partial sectional view illustrating a developing apparatus for a conventional image forming apparatus;

DETAILED DESCRIPTION OF THE PREFERRED EMBODIMENTS

Figure 2:
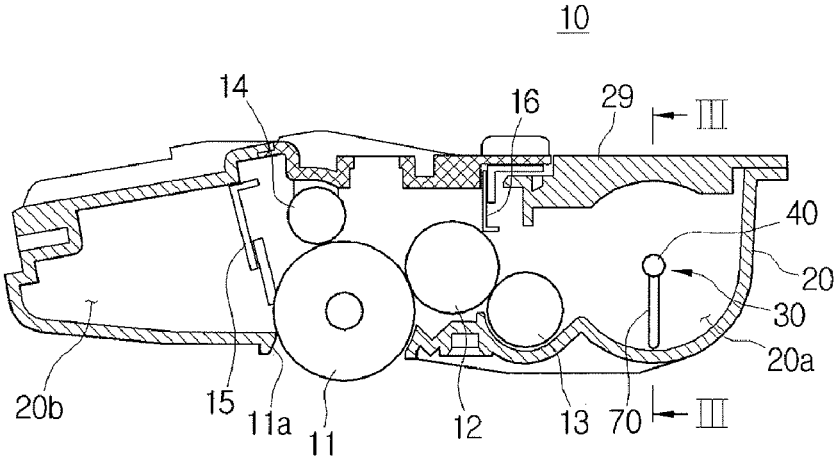
FIG. 2 is a sectional view illustrating a developing apparatus for an image forming apparatus according to an exemplary embodiment of the present general inventive concept.

Reference will now be made in detail to embodiments of the present general inventive concept, examples of which are illustrated in the accompanying drawings, wherein like reference numerals refer to the like elements throughout. The embodiments are described below in order to explain the present general inventive concept by referring to the figures.

Figure 3:
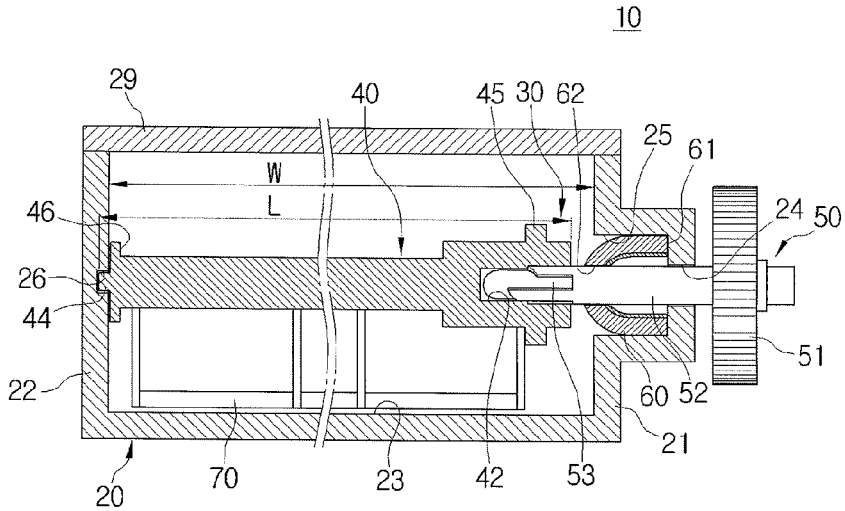
FIG. 3 is a sectional view illustrating the developing apparatus for the image forming apparatus of FIG. 2 taken along a line III-III in FIG. 2.

Referring to FIGS. 2 and 3, a developing apparatus 10 for an image forming apparatus according to an exemplary embodiment of the present general inventive concept includes a developer receptacle 20, an agitator 30, a photosensitive medium 11, a developing roller 12, a developer supplying roller 13, a charging roller 14, and a used developer-removing member 15.

The developer receptacle 20 supports the agitator 30, the photosensitive medium 11, the developing roller 12, the developer supplying roller 13, the charging roller 14, and the used developer-removing member 15. A developer-storing portion 20*a* to store developer is formed in one side inside the developer receptacle 20. A used developer-storing portion 20*b* to store used developer removed from the photosensitive medium 11 is formed in an opposite side of the developer-storing portion 20*a* based on the photosensitive medium 11. A lid 29 covers a top portion of the developer receptacle 20.

A power transmitting unit (not illustrated) is disposed outside a sidewall of the developer receptacle 20 to transmit power to the developing roller 12, the developer supplying roller 13, and the agitator 30. In this exemplary embodiment, the power transmitting unit includes a photosensitive medium gear (not illustrated) disposed on a shaft of the photosensitive medium 11, a developing roller gear (not illustrated) disposed on a shaft of the developing roller 12, and a developer supplying roller gear (not illustrated) disposed on a shaft of the developer supplying roller 13. Also, the power transmitting unit may include a gear train (not illustrated) to connect and transmit the power to the photosensitive medium gear, the developing roller gear, and the developer supplying roller gear. As a result, when the developing apparatus 10 is mounted to a main body 110 (see FIG. 10) of the image forming apparatus 100 (see FIG. 10), the photosensitive medium gear receives power from a driving gear (not illustrated) disposed in the main body 110 of the image forming apparatus 100. When the photosensitive medium gear rotates, the developing roller 12 and the developer supplying roller 13 rotate via the power transmitting unit.

Referring to FIGS. 2 and 3, the agitator 30 is rotatably disposed in the developer-storing portion 20*a* of the developer receptacle 20, and prevents the developer stored in the developer receptacle 20 from solidifying (i.e., from becoming solid). The agitator 30 receives power from the power transmitting unit to rotate, and includes a rotation shaft 40, a driving member 50, and an agitating member 70.

The rotation shaft 40 is disposed inside the developer receptacle 20. Opposite ends of the rotation shaft 40 are rotatably supported by opposite sidewalls 21 and 22 of the developer receptacle 20. The rotation shaft 40 may have a length L shorter than a distance W between the opposite sidewalls 21 and 22 of the developer receptacle 20. Here, the distance W between the opposite sidewalls 21 and 22 of the developer receptacle 20, as illustrated in FIG. 3, refers to a gap between inner surfaces of the two sidewalls 21 and 22 of the developer receptacle 20 to face each other. Accordingly, the rotation shaft 40 can linearly move vertical to a bottom surface 23 of the developer receptacle 20 while remaining horizontal with respect to the bottom surface 23 of the developer receptacle 20 so as to be assembled inside the developer receptacle 20 from above the developer receptacle 20. Therefore, the automatic machines (not illustrated) like robots, etc. able to only linearly move in a vertical direction can be used to insert the rotation shaft 40 into the inside of the developer receptacle 20.

Figure 4:
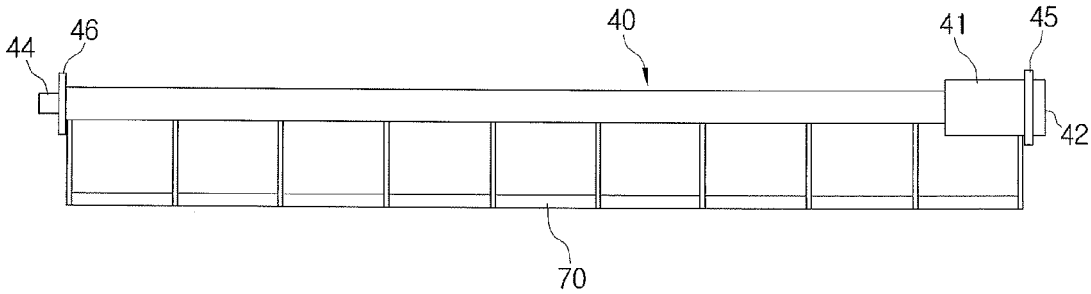
FIG. 4 is a front view illustrating a rotation shaft and an agitating member of the developing apparatus of FIG. 3.
Figure 5:
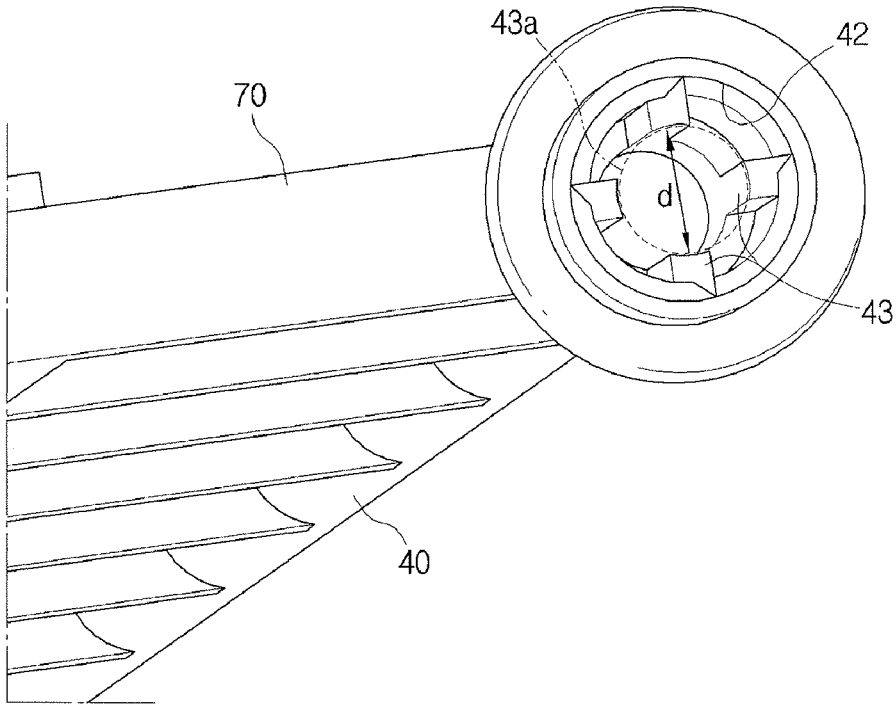
FIG. 5 is an enlarged partial perspective view illustrating a connection hole of the rotation shaft of FIG. 4.

On one end (hereinafter, refer to a first end) of the rotation shaft 40 is formed a connection hole 42 to which the driving member 50 is coupled. On the other end (hereinafter, refer to a second end) of the rotation shaft 40 is formed a supporting projection 44. A first wing 45 and a second wing 46 are formed to radially project from an outer circumferential surface of the rotation shaft 40 nearby each of the first and second ends of the rotation shaft 40. As illustrated in FIG. 4, a portion 41 of the rotation shaft 40 in which the connection hole 42 is formed may have a diameter larger than another portion of the rotation shaft 40. Referring to FIG. 5, a plurality of coupling protrusions 43 is formed on an inner circumferential surface of the connection hole 42 of the rotation shaft 40 in an axial direction of the rotation shaft 40. In this exemplary embodiment, four coupling protrusions 43 are formed by 90 degrees intervals. However, a number of the coupling protrusions 43 formed in the connection hole 42 is not limited, and may be greater than or less than the four coupling protrusions 43 as desired.

Referring to FIG. 3, a shaft hole 24 into which a connecting shaft 52 of the driving member 50 is inserted is formed on the sidewall 21 (hereinafter, refer to a first sidewall) of the developer receptacle 20 to face the connection hole 42 of the rotation shaft 40 of the agitator 30. The shaft hole 24 is formed to rotatably support the connecting shaft 52 of the driving member 50. Optionally, a bearing may be disposed between the shaft hole 24 and the connecting shaft 52 of the driving member 50 to assist a rotation movement of the connecting shaft 52.

A sealing member seat 25 in which a sealing member 60 is disposed may be formed around the shaft hole 24 of the first sidewall 21 of the developer receptacle 20. The sealing member seat 25 is formed substantially in a hollow cylindrical shape to project outside from the first sidewall 21 of the developer receptacle 20. The shaft hole 24 is formed on a bottom surface of the sealing member seat 25 so that a center axis of the shaft hole 24 is coincided with a center axis of the sealing member seat 25. The sealing member seat 25 may be molded integrally with the first sidewall 21 of the developer receptacle 20 when molding the developer receptacle 20.

Figure 8:
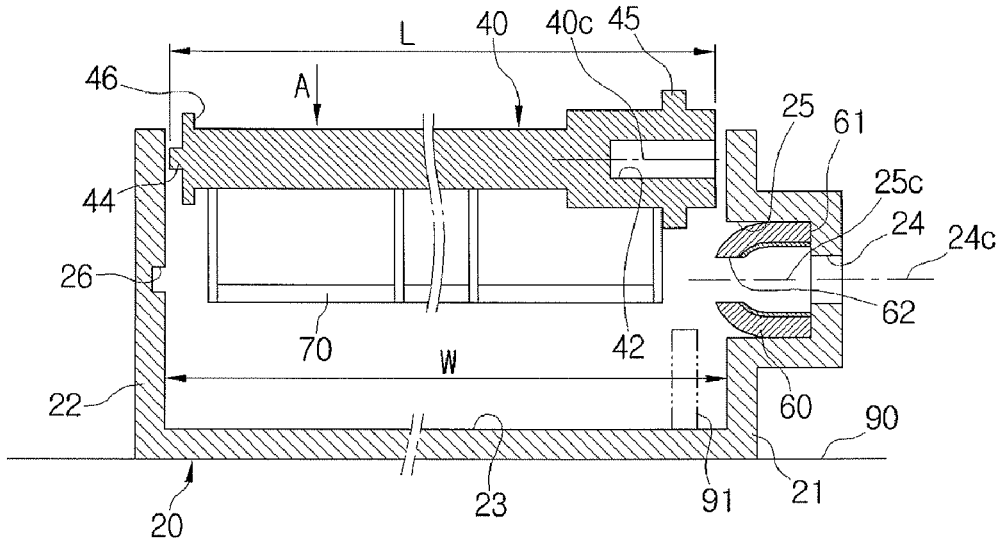
FIG. 8 is a sectional view illustrating a developing apparatus for an image forming apparatus according to an exemplary embodiment of the present general inventive concept in a state that a rotation shaft is assembled to a developer receptacle.

The sealing member 60 prevents the developer stored in the developer receptacle 20 from leaking from a gap between the connecting shaft 52 of the driving member 50 and the shaft hole 24 formed on the first sidewall 21 of the developer receptacle 20. The sealing member 60 may be formed substantially in a bell shape or in a U shape as illustrated in FIGS. 3 and 8. One end 61 of the sealing member 60 has an outer diameter corresponding to an inner diameter of the sealing member seat 25 formed on the first sidewall 21 of the developer receptacle 20. A sealing hole 62 is formed on the other end of the sealing member 60, and has a diameter corresponding to an outer diameter of the connecting shaft 52 of the driving member 50. The sealing member 60 may be formed of an elastic material. Therefore, when the sealing member 60 is inserted into the connecting shaft 52 of the driving member 50, an inner surface of the sealing hole 62 of the sealing member 60 contacts an outer circumferential surface of the connecting shaft 52, thereby preventing the developer stored in the developer-storing portion 20*a* of the developer receptacle 20 from leaking. Accordingly, since the sealing member 60 radially applies pressure to the connecting shaft 52 of the driving member 50, the inner surface of the sealing hole 62 of the sealing member 60 closely contacts the outer circumferential surface of the connecting shaft 52 so that the sealing member 60 seals the outer circumferential surface of the connecting shaft 52. Also, since the one end 61 of the sealing member 60 has the outer diameter corresponding to the inner diameter of the sealing member seat 25, if the sealing member 60 is inserted in the sealing member seat 25, the sealing member 60 is fixed to the first sidewall 21 of the developer receptacle 20. As a result, even when the connecting shaft 52 of the driving member 50 rotates, the sealing member 60 does not rotate. Also, the sealing member 60 may be disposed in the sealing member seat 25 so that the sealing hole 62 of the sealing member 60 faces the rotation shaft 40 as illustrated in FIG. 3.

The supporting projection 44 of the rotation shaft 40, as illustrated in FIG. 3, is formed to insert into a supporting hole 26 formed on the opposite sidewall 22 (hereinafter, refer to a second sidewall) to the first sidewall 21 of the developer receptacle 20. In this exemplary embodiment, the supporting projection 44 is formed on the second end of the rotation shaft 40, and the supporting hole 26 is formed on the second sidewall 22. The length L of the rotation shaft 40 is shorter than the distance W between the first sidewall 21 and second sidewall 22 of the developer receptacle 20 so that the rotation shaft 40 can linearly move vertical to the bottom surface 23 of the developer receptacle 20 while being horizontal with respect to the bottom surface 23 of the developer receptacle 20.

In addition, in another exemplary embodiment (not illustrated), the supporting hole may be formed on the second end of the rotation shaft 40, and the supporting projection inserted into the supporting hole of the rotation shaft 40 may be formed on the second sidewall 22 of the developer receptacle 20. In this exemplary embodiment, the length L of the rotation shaft 40 should be shorter than the distance W between a top end of the supporting projection and the first sidewall 21 of the developer receptacle 20 so that the rotation shaft 40 can linearly move vertical to the bottom surface 23 of the developer receptacle 20 while being horizontal with respect to the bottom surface 23 of the developer receptacle 20.

Figure 6:
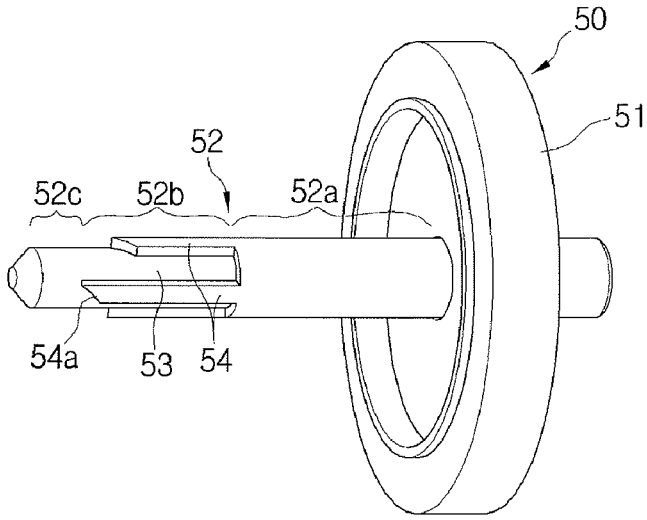
FIG. 6 is a perspective view illustrating a driving member of the developing apparatus of FIG. 3.

The driving member 50 is rotatably supported by the shaft hole 24 formed on the first sidewall 21 of the developer receptacle 20, and receives power from the power transmitting unit (not illustrated) to rotate. Referring to FIG. 6, the driving member 50 includes a gear portion 51 and the connecting shaft 52. The gear portion 51 receives power from the power transmitting unit disposed on the outer surface of the first sidewall 21 of the developer receptacle 20.

The connecting shaft 52 is formed in a single body with the gear portion 51, and rotates integrally with the gear portion 51. The connecting shaft 52 supports the gear portion 51 to rotate. The connecting shaft 52 is coupled with the connection hole 42 of the rotation shaft 40, to allow the rotation shaft 40 to rotate integrally with the driving member 50.

In this exemplary embodiment, the connecting shaft 52 includes three portions, that is, a rotation supporting portion 52*a*, a coupling portion 52*b*, and a top portion 52*c*. The rotation supporting portion 52*a* is inserted into the shaft hole 24 formed on the first sidewall 21 of the developer receptacle 20, and is supported by the shaft hole 24. Also, an outer circumferential surface of the rotation supporting portion 52*a* of the connecting shaft 52 contacts the sealing hole 62 of the sealing member 60, thereby preventing the developer from leaking from the developer receptacle 20.

The coupling portion 52*b* of the connecting shaft 52 can be located between the rotation supporting portion 52*a* and the top portion 52*b*, and has a plurality of coupling grooves 53 formed in an axial direction of the connecting shaft 52. The plurality of coupling grooves 53 is formed to correspond to the plurality of coupling protrusions 43 formed on the connection hole 42 of the rotation shaft 40, and is open toward the top portion 52*c*. Therefore, when the connecting shaft 52 is inserted into the connection hole 42 of the rotation shaft 40, the plurality of coupling grooves 53 of the connecting shaft 52 and coupling protrusions 43 of the connection hole 42 engage each other. So, when the driving member 50 rotates, the rotation shaft 40 is rotated by the plurality of coupling grooves 53 and coupling protrusions 43 engaging each other. The plurality of coupling grooves 53 is formed by a plurality of partitions 54. Also, one partition 54*a* of the plurality of partitions 54 may be formed to have the longest length than the other partitions (see FIG. 6), which allows the plurality of coupling grooves 53 to be easily inserted into the coupling protrusions 43 when the connecting shaft 52 is inserted into the connection hole 42.

The top portion 52*c* of the connecting shaft 52 has a diameter smaller than a diameter d of an imaginary circle 43*a* formed by top ends of the plurality of coupling protrusions 43 formed on the connection hole 42 of the rotation shaft 40 so as to guide the connection of the connecting shaft 52 and the connection hole 42 of the rotation shaft 40.

The agitating member 70 is disposed on the rotation shaft 40, and rotates integrally with the rotation shaft 40. Therefore, when the driving member 50 coupled to the connection hole 42 of the rotation shaft 40 rotates the rotation shaft 40, the agitating member 70 also rotates integrally with the rotation shaft 40. In this exemplary embodiment, the agitating member 70 is formed substantially in a rectangular shape; however, this should not be considered as limiting. The agitating member 70 may be formed in various shapes and include a screw, etc.

Referring to FIGS. 2 and 3, the photosensitive medium 11 is rotatably disposed inside the developer receptacle 20, and a portion of the photosensitive medium 11 is exposed outside through a photosensitive medium opening 11*a* formed on the bottom surface 23 of the developer receptacle 20. A light exposure unit 170 (see FIG. 10) emits a laser beam to form a predetermined electrostatic latent image on the photosensitive medium 11. The developing roller 12 is rotatably disposed at a side of the photosensitive medium 11 to supply the developer to the photosensitive medium 11, thereby developing the electrostatic latent image into a visible image. The developer supplying roller 13 is rotatably disposed at a side of the developing roller 12 to supply the developing roller 12 with the developer stored in the developer-storing portion 20*a*. A regulating member 16 is disposed above the developing roller 12 to regulate the developer on the developing roller 12 into a thin developer layer. The charging roller 14 is disposed above the photosensitive medium 11 to charge a surface of the photosensitive medium 11 by a predetermined voltage. The used developer-removing member 15 removes used developer remaining on the photosensitive medium 11 after the visible image is transferred onto the printing medium, and collects the used developer into the used developer-storing portion 20*b*. The photosensitive medium 11, the developing roller 12, the developer supplying roller 13, the regulating member 16, the charging roller 14, and the used developer-removing member 15 as described above are similar to those of the developing apparatus of the conventional image forming apparatus. Therefore, detailed explanations thereof will be omitted.

Hereinafter, operation of the developing apparatus 10 for the image forming apparatus according to an exemplary embodiment of the present general inventive concept will be explained with reference to FIGS. 2 and 3.

If the developing apparatus 10 is mounted on the main body 110 of the image forming apparatus 100, the photosensitive medium gear (not illustrated) of the photosensitive medium 11 is engaged with the driving gear (not illustrated) disposed in the main body 110. When a printing operation begins, the driving gear rotates, so the photosensitive medium gear rotates. When the photosensitive medium 11 rotates together with the photosensitive medium gear, the driving member 50 receives power via the power transmitting unit (not illustrated) to rotate. When the driving member 50 rotates, the rotation shaft 40 coupled with the driving member 50 rotates integrally with the driving member 50.

Hereinafter, a process of the driving member 50 causing the rotation shaft 40 to rotate integrally therewith will be explained in detail.

When the gear portion 51 of the driving member 50 receives power via the power transmitting unit, the gear portion 51 rotates on the connecting shaft 52 supported by the shaft hole 24 of the developer receptacle 20. At this time, the plurality of coupling grooves 53 of the connecting shaft 52 is engaged with the plurality of coupling protrusions 43 of the connection hole 42 of the rotation shaft 40 so that when the connecting shaft 52 rotates, the rotation shaft 40 rotates integrally with the connecting shaft 52. When the rotation shaft 40 rotates, the agitating member 70 connected to the rotation shaft 40 also rotates. As a result, the agitating member 70 agitates the developer stored in the developer-storing portion 20*a* of the developer receptacle 20.

At this time, the connecting shaft 52 of the driving member 50 is sealed by the sealing member 60 disposed in the sealing member seat 25 so that the developer does not leak from the gap between the connecting shaft 52 and the shaft hole 24 of the developer receptacle 20.

The developer supplying roller 13 and developing roller 12 supply the photosensitive medium 11 with the developer being agitated by the agitating member 70. Then, the developer develops the electrostatic latent image formed on the photosensitive medium 11 into the visible image.

Figure 7:
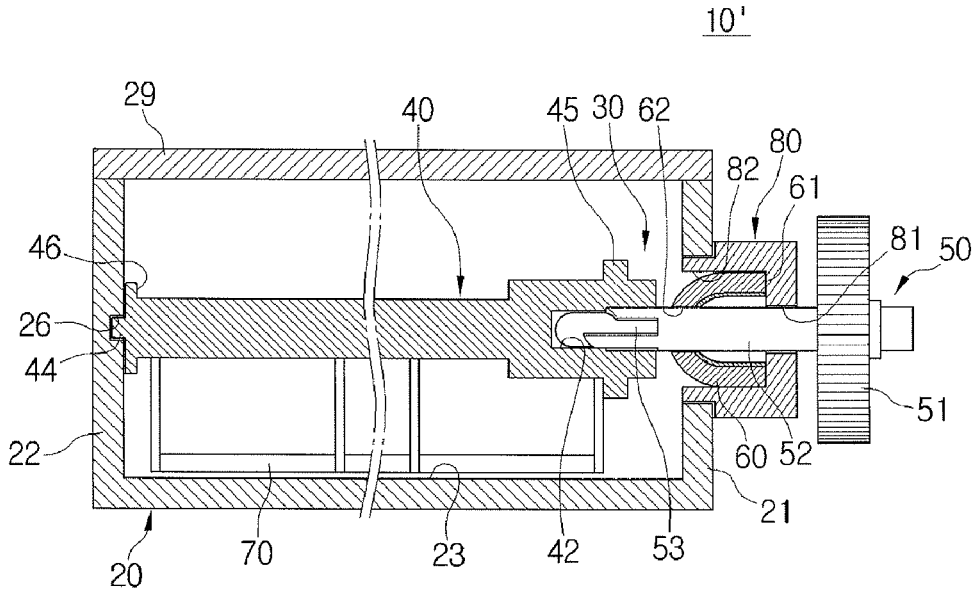
FIG. 7 is a sectional view illustrating a developing apparatus for an image forming apparatus according to another exemplary embodiment of the present general inventive concept.

FIG. 7 illustrates the developing apparatus 10' for the image forming apparatus according to another exemplary embodiment of the present general inventive concept. As illustrated in FIG. 7, the developing apparatus 10' is substantially the same as the developing apparatus 10 according to the above-described exemplary embodiment, except that a shaft supporting member 80 formed separately from the developer receptacle 20 is disposed at the first sidewall 21 of the developer receptacle 20 to rotatably support the connecting shaft 52 of the driving member 50.

The shaft supporting member 80 is provided with a shaft supporting hole 81 to rotatably support the connecting shaft 52 of the driving member 50, and a sealing member fixing hole 82 formed inside the shaft supporting member 80. A center axis of the sealing member fixing hole 82 is aligned with a center axis of the shaft supporting hole 81. The sealing member 60 is disposed in the sealing member fixing hole 82 to seal an outer circumferential surface of the connecting shaft 52 of the driving member 50. The shaft supporting hole 81 and the sealing member fixing hole 82 are similar to the shaft hole 24 and the sealing member seat 25 of the developing apparatus 10 according to the above-described exemplary embodiment. Therefore, detailed explanations thereof will be omitted.

Hereinafter, an assembling method of the developing apparatus 10 for the image forming apparatus according to an exemplary embodiment of the present general inventive concept having the structure as described above will be explained with reference to FIGS. 8 and 9.

First, the sealing member 60 is assembled in the sealing member seat 25 of the developer receptacle 20. After that, the developer receptacle 20 with the sealing member 60 is put on an assembly table 90. Next, the rotation shaft 40 is inserted into the developer receptacle 20 so that the connection hole 42 of the rotation shaft 40 faces the sealing member 60. At this time, the rotation shaft 40 is located so that the center axis 40*c* of the rotation shaft 40 is aligned with the center axis 24*c* of the shaft hole 24 of the developer receptacle 20. That is, the center axis 40*c* of the rotation shaft 40 is assembled to locate in the same axis as the center axes 24*c* and 25*c* of the shaft hole 24, the sealing member seat 25, and the sealing member 60. If a rotation shaft supporting member 91 is disposed on the bottom surface 23 of the developer receptacle 20 to support the rotation shaft 40, the center axis 40*c* of the rotation shaft 40 can be easily aligned with the center axis 24*c* of the shaft hole 24.

In the developing apparatus 10 according to an exemplary embodiment of the present general inventive concept, because the rotation shaft 40 has the length L shorter than the distance W between the opposite sidewalls 21 and 22 of the developer receptacle 20, the rotation shaft 40 can be inserted in a vertical direction (arrow A) inside the developer receptacle 20 while remaining horizontal with respect to the bottom surface 23 of the developer receptacle 20 as illustrated in FIG. 8. As a result, automatic machines such as robots, etc. that can perform only a linear motion can be used to assembly the rotation shaft 40 to the developer receptacle 20.

In a state in which the center axes 40*c* and 24*c* of the rotation shaft 40 and the shaft hole 24 are aligned with each other, the rotation shaft 40 is moved to the second sidewall 22 of the developer receptacle 20. Then, the supporting projection 44 formed on the second end of the rotation shaft 40 is inserted into the supporting hole 26 of the second sidewall 22. At this state, the driving member 50 is located outside the first sidewall 21 of the developer receptacle 20, as illustrated in FIG. 9, so that the center axis 50*c* of the connecting shaft 52 of the driving member 50 is aligned with the center axis 24*c* of the shaft hole 24 of the developer receptacle 20.

Figure 9:
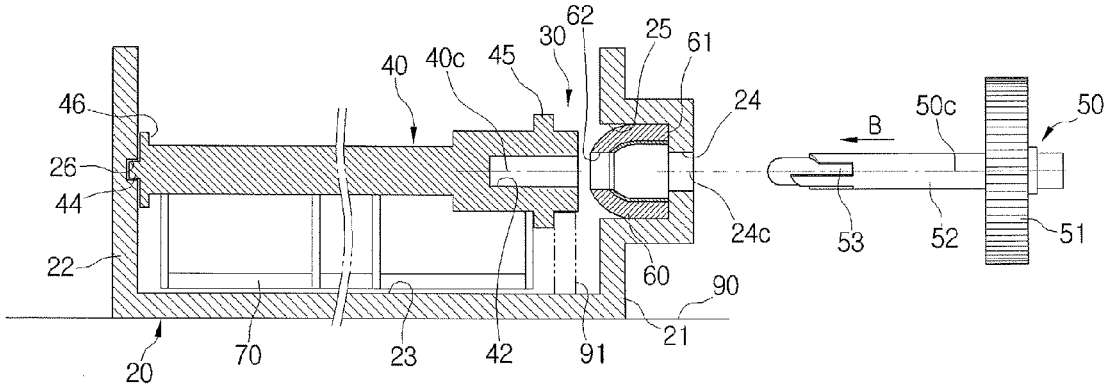
FIG. 9 is a sectional view illustrating a driving member that is being assembled to a rotation shaft assembled to a developer receptacle of a developing apparatus for an image forming apparatus according to an exemplary embodiment of the present general inventive concept.

In this state, the driving member 50 is pushed to the developer receptacle 20 as arrow B illustrated in FIG. 9 so that the connecting shaft 52 of the driving member 50 passes in order through the shaft hole 24 of the developer receptacle 20 and the sealing hole 62 of the sealing member 60, and then, is inserted into the connection hole 42 of the rotation shaft 40. As a result, the driving member 50 is coupled to the rotation shaft 40 (see FIG. 3). At this time, since the top portion 52*c* of the connecting shaft 52 of the driving member 50 has the diameter smaller than the diameter of the circle d formed by the top ends of the plurality of coupling protrusions 43 of the connection hole 42, and one partition 54*a* of the plurality of partitions 54 is the longest than the other partitions, when the driving member 50 is pushed to the rotation shaft 40, the plurality of coupling protrusions 43 of the connection hole 42 of the rotation shaft 40 is precisely inserted into the plurality of coupling grooves 53 of the connecting shaft 52 of the driving member 50.

After that, the lid 29 is covered on the top portion of the developer receptacle 20 so that the assembly of the developing apparatus 10 is completed.

With the assembling method of the developing apparatus 10 according to an exemplary embodiment of the present general inventive concept as described above, the rotation shaft 40 can be moved in the vertical direction while remaining horizontal with respect to the bottom surface 23 of the developer receptacle 20 so that it is easy to use automatic machines such as robots, etc. to assemble the developing apparatus 10.

Figure 11:
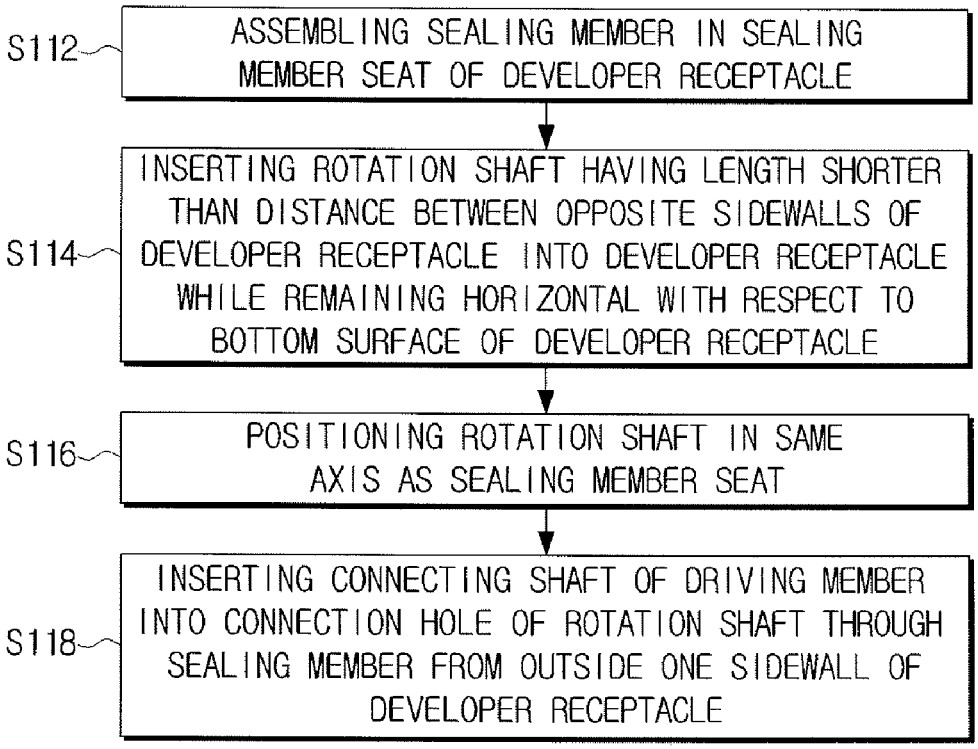
FIG. 11 is a flowchart illustrating an assembling method of a developing apparatus according to an exemplary embodiment of the present general inventive concept.

FIG. 11 is a flowchart illustrating an assembling method of a developing apparatus 10 according to an exemplary embodiment of the present general inventive concept. Referring to FIG. 11, in operation S112, a sealing member 60 in a sealing member seat 25 of a developer receptacle 20 is assembled. In operation S114, a rotation shaft 40 having a length shorter than a distance between opposite sidewalls 21 and 22 of the developer receptacle 20 is inserted into the developer receptacle 20 while remaining horizontal with respect to a bottom surface 23 of the developer receptacle 20. In operation S116, the rotation shaft 40 is positioned in a same axis as the sealing member seat 25. In operation S118, a connecting shaft 52 of a driving member 50 is inserted into a connection hole 42 of the rotation shaft 40 through the sealing member 60 from outside one sidewall 21 and 22 of the developer receptacle 20.

Hereinafter, the image forming apparatus 100 having the developing apparatus 10 according to an exemplary embodiment of the present general inventive concept will be explained with reference to FIG. 10.

Figure 10:
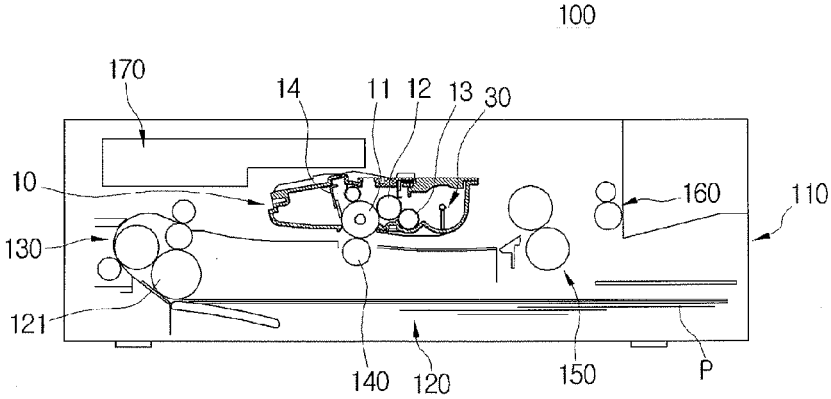
FIG. 10 is a sectional view illustrating an image forming apparatus having a developing apparatus according to an exemplary embodiment of the present general inventive concept.

Referring to FIG. 10, the image forming apparatus 100 having the developing apparatus 10 according to an exemplary embodiment of the present general inventive concept includes the main body 110, a printing medium feeding unit 120, a conveying roller unit 130, the light exposure unit 170, the developing apparatus 10, a transfer roller 140, a fixing unit 150, and a discharging unit 160.

The main body 110 forms an appearance of the image forming apparatus 100. The printing medium feeding unit 120, the conveying roller unit 130, the light exposure unit 170, the developing apparatus 10, the transfer roller 140, the fixing unit 150, and the discharging unit 160 are disposed inside the main body 110.

The printing medium feeding unit 130 is disposed at a lower portion of the main body 110, and stores a plurality of printing media P therein. A pickup roller 121 is disposed at a leading end of the printing medium feeding unit 120 to pick up and feed the stored printing media P one by one.

The conveying roller unit 130 includes at least one pair of conveying rollers, and conveys the printing medium P picked up from the printing medium feeding unit 120 between the transfer roller 140 and the photosensitive medium 11.

The light exposure unit 170 is disposed above the developing apparatus 10, and scans the laser beam corresponding to the printing data onto the photosensitive medium 11 of the developing apparatus 10.

The developing apparatus 10 is detachably disposed inside the main body 110 of the image forming apparatus 100 to form images corresponding to the printing data. When the developing apparatus 10 is disposed inside the main body 110 of the image forming apparatus 100, the photosensitive medium gear is engaged with the driving gear disposed inside the main body 110 so that the photosensitive medium 11 can rotate. The structure and operation of the developing apparatus 10 are similar to those of the developing apparatus 10 according to an exemplary embodiment of the present general inventive concept as described above. Therefore, detailed descriptions thereof will be omitted.

The transfer roller 140 is rotatably disposed under the developing apparatus 10 to face the photosensitive medium 11 of the developing apparatus 10, and allows the image formed on the photosensitive medium 11 to be transferred onto the printing medium P conveyed from the printing medium feeding unit 120.

The fixing unit 150 is disposed downstream the transfer roller 140, and includes a pressure roller and a heat roller. The fixing unit 150 applies heat and pressure to the printing medium P passing between the pressure roller and the heat roller so that the image is fixed onto the printing medium P.

The discharging unit 160 discharges the printing medium P on which the image is fixed in the fixing unit 150 outside the image forming apparatus 100.

Hereinafter, operation of the image forming apparatus 100 according to an exemplary embodiment of the present general inventive concept having the structure as described above will be explained with reference to FIG. 10.

When receiving a printing order, the image forming apparatus 100 applies a voltage to the charging roller 14 of the developing apparatus 10 so as to charge the surface of the photosensitive medium 11 by a predetermined voltage.

After that, the image forming apparatus 100 operates the driving motor (not illustrated) to rotate the driving gear (not illustrated). When the driving gear rotates, the photosensitive medium gear engaged with the driving gear rotates so that the photosensitive medium 11 rotates. When the photosensitive medium 11 rotates, the power transmitting unit allows the developing roller 12, the developer supplying roller 13, and the agitator 30 to rotate so that the developer is supplied to the photosensitive medium 11.

Also, the image forming apparatus 100 operates the light exposure unit 170 to scan the laser beam corresponding to the printing data. The laser beam scanned from the light exposure unit 170 forms an electrostatic latent image corresponding to the printing data on the photosensitive medium 11.

When the photosensitive medium 11 continues to rotate, the electrostatic latent image formed on the photosensitive medium 11 moves to a position to face the developing roller 12. Then, the developer forming the developer layer on the developing roller 12 moves to the photosensitive medium 11 to develop the electrostatic latent image into the visible image.

Alternatively, when receiving the printing order, the printing medium feeding unit 120 picks up one printing medium P from the stored printing media, and feeds the printing medium P to the conveying roller unit 130. The conveying roller unit 130 conveys the picked up printing medium P between the transfer roller 140 and the photosensitive medium 11 of the developing apparatus 10.

When the printing medium P enters between the photosensitive medium 11 and the transfer roller 140, the visible image is transferred from the photosensitive medium 11 to the printing medium P.

When the photosensitive medium 11 continues to rotate, the used developer-removing member 15 (see FIG. 2) removes the used developer remaining on a surface of the photosensitive medium 11 after the visible image is transferred onto the printing medium P. The used developer removed from the photosensitive medium 11 is stored into the used developer-storing portion 20*b*.

When the photosensitive medium 11 continues to rotate, and a portion of the photosensitive medium 11 from which the used developer is removed faces the charging roller 14, the charging roller 14 again charges the portion of the photosensitive medium 11 by a predetermined voltage.

The photosensitive medium 11 charged by a predetermined voltage repeats the above-described process to allow the visible image to be transferred onto the printing medium P.

The printing medium P having the visible image transferred from the photosensitive medium 11 of the developing apparatus 10 moves to the fixing unit 150. While the printing medium P passes between the pressure roller and the heat roller of the fixing unit 150, the visible image is fixed onto the printing medium P.

The discharging unit 160 discharges the printing medium P having the visible image fixed thereon outside the image forming apparatus 100.

With a developing apparatus according to various embodiments of the present general inventive concept, an image forming apparatus having the same, and an assembling method of a developing apparatus, a rotation shaft can be moved in a vertical direction while remaining horizontal with respect to a bottom surface of a developer receptacle. Therefore, automatic machines such as robots, etc. can be used to automatically assemble the developing apparatus.

Also, with a developing apparatus according to various embodiments of the present general inventive concept, an image forming apparatus having the same, and an assembly method of the developing apparatus, a sealing member seals an outer circumferential surface of a connecting shaft of a driving member. Therefore, developer stored in the developing apparatus does not leak from a gap between a rotation shaft and a shaft hole.

Although various embodiments of the present general inventive concept have been illustrated and described, it will be appreciated by those skilled in the art that changes may be made in these embodiments without departing from the principles and spirit of the general inventive concept, the scope of which is defined in the appended claims and their equivalents.

What is claimed is:

1. A developing apparatus usable with an image forming apparatus the developing apparatus comprising:

a developer receptacle having a sidewall on which a shaft hole is formed;

a rotation shaft having a first end at a distal point of a support projection and a second end at which a connection hole is formed and a length between the first and second ends that is shorter than a distance between opposite sidewalls of the developer receptacle; and a driving member rotatably supported by the shaft hole of the developer receptacle, and having a connecting shaft inserted into the connection hole of the rotation shaft.

2. The developing apparatus of claim 1, further comprising:

a sealing member seat formed around the shaft hole on the sidewall of the developer receptacle; and a sealing member disposed in the sealing member seat to seal an outer circumferential surface of the connecting shaft of the driving member.

3. The developing apparatus of claim 2, wherein the sealing member is formed substantially in a U shape or in a bell shape.

4. The developing apparatus of claim 1, wherein the connection hole of the rotation shaft comprises:

a plurality of coupling protrusions formed in an axial direction thereof.

5. The developing apparatus of claim 4, wherein the driving member comprises:

a plurality of coupling grooves formed on an outer circumferential surface of the connecting shaft corresponding to the plurality of coupling protrusions.

6. The developing apparatus of claim 5, wherein the driving member comprises:

a plurality of partitions to form the plurality of coupling grooves, and one partition of the plurality of partitions is longer than other partitions.

7. The developing apparatus of claim 1, further comprising:

an agitator disposed on the rotation shaft to agitate developer stored in the developer receptacle.

8. A developing apparatus usable with an image forming apparatus, the developing apparatus comprising:

a developer receptacle;

a rotation shaft having a first end at a distal point of a support projection and a second end at which a connection hole is formed and a length between the first and second ends that is shorter than a distance between opposite sidewalls of the developer receptacle;

a shaft supporting member disposed at one sidewall of the developer receptacle, and having a shaft supporting hole; and a driving member rotatably supported by the shaft supporting hole of the shaft supporting member, and having a connecting shaft inserted into the connection hole of the rotation shaft.

9. The developing apparatus of claim 8, wherein the shaft supporting member comprises:

a sealing member fixing hole formed at a same axis as the shaft supporting hole; and a sealing member disposed in the sealing member fixing hole to seal an outer circumferential surface of the connecting shaft of the driving member.

10. The developing apparatus of claim 9, wherein the sealing member is formed substantially in a U shape or in a bell shape.

11. An image forming apparatus, comprising:

a printing medium feeding unit;

a developing apparatus to form an image on a photosensitive medium;

a transfer roller to allow the image formed on the photosensitive medium to be transferred onto a printing medium fed from the printing medium feeding unit; and a fixing unit to fix the image onto the printing medium;

wherein the developing apparatus comprises:

a developer receptacle having a sidewall on which a shaft hole is formed;

a rotation shaft having a first end at a distal point of a support projection and a second end at which a connection hole is formed and a length between the first and second ends that is shorter than a distance between opposite sidewalls of the developer receptacle; and a driving member rotatably supported by the shaft hole of the developer receptacle, and having a connecting shaft inserted into the connection hole of the rotation shaft.

12. The image forming apparatus of claim 11, wherein the developing apparatus further comprises:

a sealing member seat formed around the shaft hole on the sidewall of the developer receptacle; and a sealing member disposed in the sealing member seat to seal an outer circumferential surface of the connecting shaft of the driving member.

13. An image forming apparatus, comprising:

a printing medium feeding unit;

a developing apparatus to form an image on a photosensitive medium;

a transfer roller to allow the image formed on the photosensitive medium to be transferred onto a printing medium fed from the printing medium feeding unit; and a fixing unit to fix the image onto the printing medium;

wherein the developing apparatus comprises:

a developer receptacle;

a rotation shaft having a first end at a distal point of a support projection and a second end at which a connection hole is formed and a length between the first and second ends that is shorter than a distance between opposite sidewalls of the developer receptacle;

a shaft supporting member disposed at one sidewall of the developer receptacle, and having a shaft supporting hole; and a driving member rotatably supported by the shaft supporting hole of the shaft supporting member, and having a connecting shaft inserted into the connection hole of the rotation shaft.

14. The image forming apparatus of claim 13, wherein the shaft supporting member comprises:

a sealing member fixing hole formed at a same axis as that of the shaft supporting hole; and a sealing member disposed in the sealing member fixing hole to seal an outer circumferential surface of the connecting shaft of the driving member.

15. An assembling method of a developing apparatus, the method comprising:

assembling a sealing member in a sealing member seat of a developer receptacle;

inserting a rotation shaft having a length shorter than a distance between opposite sidewalls of the developer receptacle into the developer receptacle while remaining horizontal with respect to a bottom surface of the developer receptacle;

positioning the rotation shaft in a same axis as the sealing member seat; and inserting a connecting shaft of a driving member into a connection hole of the rotation shaft through the sealing member from outside one sidewall of the developer receptacle.

16. The assembling method of claim 15, wherein the rotation shaft is supported by a rotation shaft supporting member disposed on the bottom surface of the developer receptacle.

17. A rotation shaft, which is rotatably disposed in a developer receptacle of a developing apparatus usable with an image forming apparatus, the rotation shaft comprising:

a first end having a support projection;

a second end at which a connection hole formed, and into which a connecting shaft of a driving member is inserted; and an agitating member disposed on the rotation shaft;

wherein a length between the first and second ends is shorter than a distance between opposite sidewalls of the developer receptacle.

18. The rotation shaft of claim 17, wherein the rotation shaft comprises:

a plurality of coupling protrusions formed on an inner circumferential surface of the connection hole in an axial direction thereof; and the connecting shaft of the driving member comprises:

a plurality of coupling grooves formed on an outer circumferential surface of the connecting shaft corresponding to the plurality of coupling protrusions.

19. A developing apparatus usable with an image forming apparatus, the developing apparatus comprising:

a developer receptacle having a bottom surface;

a rotation shaft to linearly move in a vertical direction to the bottom surface while remaining horizontal with respect to the bottom surface; and a driving member to connect to the rotation shaft;

wherein the driving member comprises a connecting shaft to extend through an opening of the developer receptacle to connect to the rotation shaft.

20. The apparatus of claim 19, wherein the developer receptacle comprises: a sealing member seat.

21. The apparatus of claim 20, wherein the apparatus further comprises:

a sealing member disposed on the sealing member seat to seal a portion of the opening of the developer receptacle surrounding the connecting shaft to prevent developer from leaking therethrough.

22. The apparatus of claim 21, wherein the sealing member comprises:

a first end having an outer diameter corresponding to an inner diameter of the sealing member seat; and a second end having a sealing hole having an inner surface to contact an outer circumferential surface of the connecting shaft to prevent the developer from leaking.

23. The apparatus of claim 19, further comprising:

a shaft supporting member coupled to a receiving portion of the developer receptacle, the shaft supporting member having a shaft supporting hole to rotatably support the connecting shaft of the driving member and a sealing member fixing hole; and a sealing member disposed on the shaft supporting member to seal an outer circumferential surface of the connecting shaft of the driving member.

24. The apparatus of claim 23, wherein a center axis of the sealing member fixing hole is aligned with a center axis of the shaft supporting hole.

25. A rotation shaft to be provided in a developer receptacle of a developing apparatus, comprising:

a support projection at a first end of the rotation shaft; and a connection hole at a second end of the rotation shaft;

wherein a length between a distal point of the support projection and the second end is shorter than a distance between opposite sidewalls of the developer receptacle.

* * * * *